US007530135B2

(12) United States Patent
Benedict

(10) Patent No.: US 7,530,135 B2
(45) Date of Patent: May 12, 2009

(54) ROTARY CARPET CLEANING MACHINE

(76) Inventor: Mark Benedict, 12090 W. 50th Pl., Wheatridge, CO (US) 80033

( * ) Notice: Subject to any disclaimer, the term of this patent is extended or adjusted under 35 U.S.C. 154(b) by 719 days.

(21) Appl. No.: 11/027,038

(22) Filed: Dec. 30, 2004

(65) Prior Publication Data

US 2006/0143843 A1 Jul. 6, 2006

(51) Int. Cl.
*A47L 11/282* (2006.01)

(52) U.S. Cl. ..... 15/50.1; 15/29

(58) Field of Classification Search ..... 15/320, 15/50.1, 29, 98

See application file for complete search history.

(56) References Cited

U.S. PATENT DOCUMENTS 1,794,462 A * 3/1931 Johnson ..... 137/584
1,803,693 A * 5/1931 Cutting ..... 15/320
1,829,132 A * 10/1931 Finnell ..... 15/50.1
1,854,638 A * 4/1932 Woods ..... 15/50.1
1,872,602 A * 8/1932 Olsen ..... 15/50.1
1,925,925 A * 9/1933 Kintzing ..... 15/50.1
1,927,226 A * 9/1933 Woods ..... 15/50.1
1,927,227 A * 9/1933 Woods ..... 427/368
2,011,234 A * 8/1935 Thompson ..... 134/174
2,039,903 A * 5/1936 Hild ..... 15/180
2,541,812 A * 2/1951 Finnell ..... 15/50.1
2,555,822 A * 6/1951 Smith ..... 15/50.1
2,600,233 A * 6/1952 Finnell ..... 15/50.1
3,192,547 A * 7/1965 Nahrstedt et al. ..... 15/4

* cited by examiner

*Primary Examiner*—Mark Spisich
(74) *Attorney, Agent, or Firm*—Leyendecker & Lemire, LLC; Kurt Leyendecker

(57) ABSTRACT

Embodiments of a rotary style carpet cleaning machine incorporating a heated reservoir of a foaming-type cleaning solution are described. The heated solution increases the chemical cleaning activity of the solution while the agitation of the carpet pile provides additional cleaning capability. In certain embodiments, a quick discount is provided on the heater assembly to permit a stair/upholstery to utilize the heated cleaning solution in the rotary cleaning machine's reservoir.

11 Claims, 8 Drawing Sheets

ROTARY CARPET CLEANING MACHINE

FIELD OF THE INVENTION

This invention generally relates to an apparatus for cleaning carpets.

BACKGROUND OF THE INVENTION

Numerous methods and associated apparatus are well known for cleaning carpets. Several of the primary methods include: steam or hot water extraction; dry foam; and dry extraction; and rotary shampoo.

Steam or hot water extraction is currently the most popular method of cleaning. It comprises spraying hot water usually including a shampoo into the carpet and quickly extracting the solution from the carpet using vacuum. The high pressure jets of the hot water solution provide agitation of the carpet fibers while the temperature of the water, which is typically 100-180 degrees, increases the cleaning effectiveness. It is to be appreciated that for every 18 degree Fahrenheit increase in the temperature of the water, the chemical cleaning activity of the solution is doubled. Hot water extraction apparatus are available in both commercial and consumer models. Commercial models, particularly truck mounted units with heaters, high powered pumps and vacuums tend to be the most effective with consumer models that rely on hot tap water and jets of lower pressure water being somewhat less effective. Perhaps the biggest draw back to hot water extraction is that it tends to leave the carpet wet. No matter how powerful the extraction vacuum, carpets that have been cleaned using this method require 8-10 or more hours to dry. The longer period of time the carpet remains wet the greater the chance mold, mildew or other microorganisms will form in the carpet fibers.

Dry foam cleaning typically involves aerating a water solution, which contains a higher percentage of shampoo or cleaner than the hot water extraction solution, into a foam that is deposited on the carpet. Most often, the foam is worked into the carpet fibers using rotating brushes, which also agitate the carpet pile to assist in the removal of dirt. As indicated by several sources, the amount of water in the foam that comes into contact with the carpet is about 1/10 the amount of hot water extraction. Some dry foam apparatus include vacuum extractors for removing the foam while in other systems the foam residue, which encapsulates the carpet dirt, is vacuumed up after the carpet has dried. Dry foam shampoos, such as Super Carpet & Upholstery Shampoo by Franklin Cleaning Technology of Great Bend, Kans. are designed for use with cool or ambient temperature water. Advantageously, a carpet cleaned using the dry foam process dries much more quickly than a carpet cleaned by hot water extraction. While the dry foam method cleans the carpet very well, it often cannot match the cleaning effectiveness of hot water extraction due largely to the reduced chemical cleaning action of the ambient solution.

Dry extraction typically involves depositing a power (or granules) that have been pre moistened with a detergent and a dry solvent onto the carpet and working the power into the carpet fibers using mechanical brushing action. The powder picks up the dirt in the carpet. After being worked into the carpet the powder and the dirt that has attached to the powder can be vacuumed up. This process uses the least amount of water or other solvents, and accordingly, requires the least amount of drying time, if any. Unfortunately, compared with hot water extraction and dry foam, this technique does not typically remove as much soil and dirt. Because the dry extraction process is both easy and quick, it is often used between scheduled more comprehensive cleanings using other methods to help maintain high traffic areas.

The Rotary shampoo process is in many respects similar to dry foam process and often the same type of shampoo is used; however instead of aerating the shampoo to cause it to foam before applying it to the carpet, the solution is first applied to the carpet and then worked into a foam through agitation of the carpet pile by a large diameter brush of a bonnet-style carpet cleaning machine. Like the dry foam process the rotary shampoo process uses relatively small amounts of water compared to the hot water extraction process, and accordingly, dries more quickly. In one variation, the cleaning solution is sprayed onto the carpet, and in another variation, the solution is deposited onto the carpet by way of a reservoir or tank contained on the bonnet-style carpet machine. In either variation, the cleaning solution is applied to the carpet is at ambient temperature. While the aggressive agitation of the carpet pile by the brush coupled with the cleaning action of the foam provides for very good cleaning, the use of an ambient cleaning solution does not facilitate the more aggressive chemical action of the hot water extraction method.

DETAILED DESCRIPTION

Figure 1:
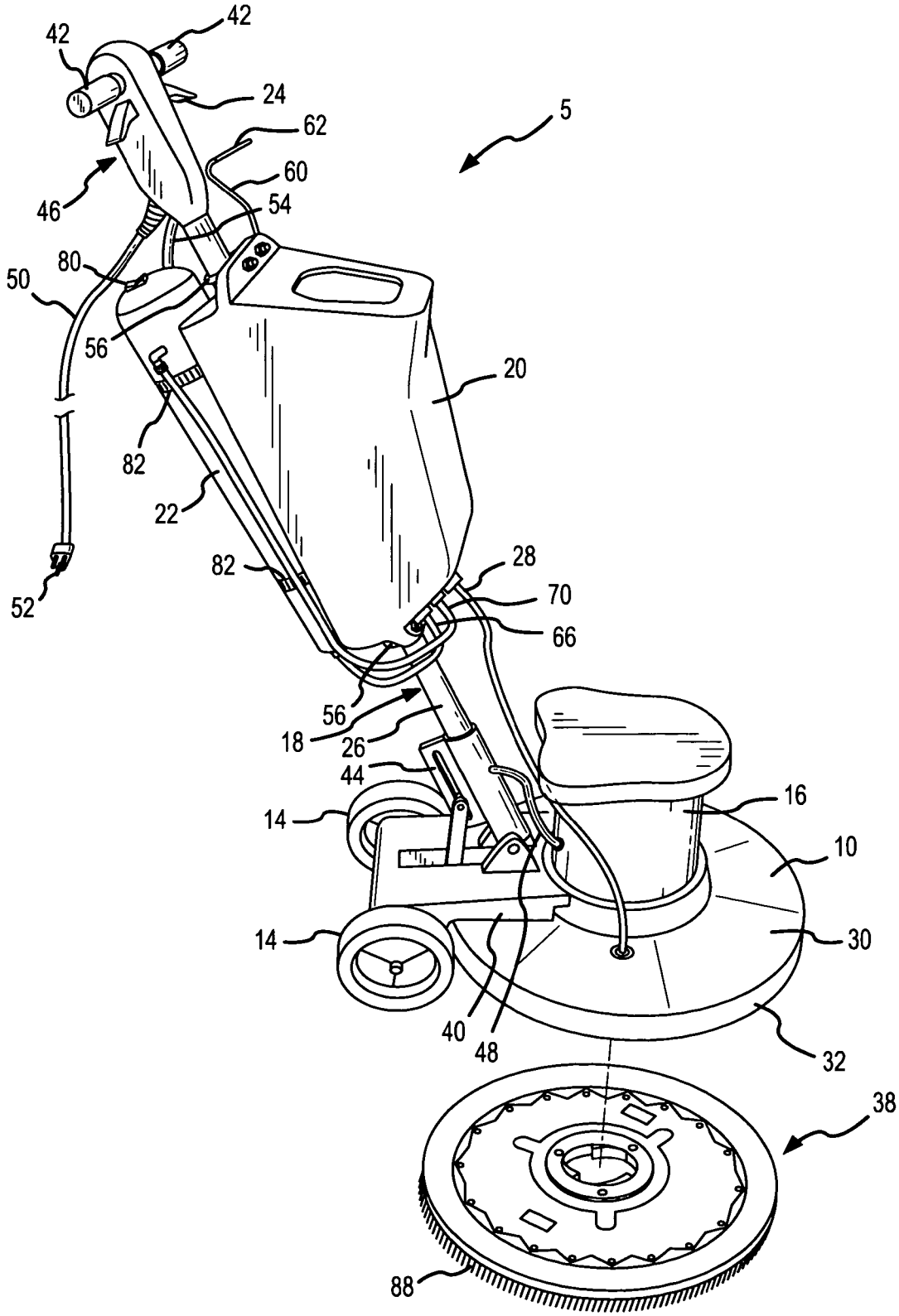
FIG. 1 is an isometric view of a carpet cleaning machine according to one embodiment of the present invention.

One embodiment of the present invention comprises a rotary (or bonnet-style) carpet cleaning machine including a reservoir for containing carpet cleaning solution and a heater assembly for heating the cleaning solution to a temperature of 160 degrees or more. The heated cleaning solution is then delivered to the carpet surface and agitated to a foam by the rotational action of the cleaner's brush. Accordingly, the one embodiment provides substantial mechanical agitation of the carpet pile through a large diameter brush and increased chemical effectiveness of the cleaning solution as a result of the higher temperatures.

In certain embodiments of the cleaning machine, the heater assembly comprises a chamber or enclosure containing an electric heater and an electric pump. The cleaning solution is pumped from proximate the bottom of the reservoir through the heater and back into the solution below the water line of the solution; thereby avoiding any aeration of the solution that could cause the formation of bubbles and foam. In one variation, a hose extends from the heater outlet to an inlet on the reservoir and includes a quick disconnect fitting. The fitting is adapted to permit a stair/upholstery cleaning tool by way of a hose having a complementary fitting attached thereto. In addition to facilitating the cleaning of stairs and upholstery, the stair/upholstery tool permits the user to clean carpet located in corners or other locations that the large diameter brush cannot reach.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term "about" as used herein unless otherwise indicated means a margin of +−10%. The term substantially as used herein unless otherwise indicated means a margin of +−5%.

The phrases "bonnet-style carpet cleaning machine" and "rotary carpet cleaning machines" are used interchangeably herein and they and obvious variations of the phrases refer to any machine having a disk shaped brush having a diameter of about more than 10" that is adapted to rotate in a plane generally parallel to the carpet surface when in operation.

The phrase "dry foam cleaning solution" and obvious variations refers to any cleaning solution for use on carpets that foams substantially when agitated and typically requires a substantially reduced amount of water to be introduced into the carpet compared to hot water extraction type machines while effectively cleaning the carpet. Typically, dry foam cleaning solutions or foams require 25% or less the amount of water introduced to the carpet compared with hot water extraction machines.

Figure 2:
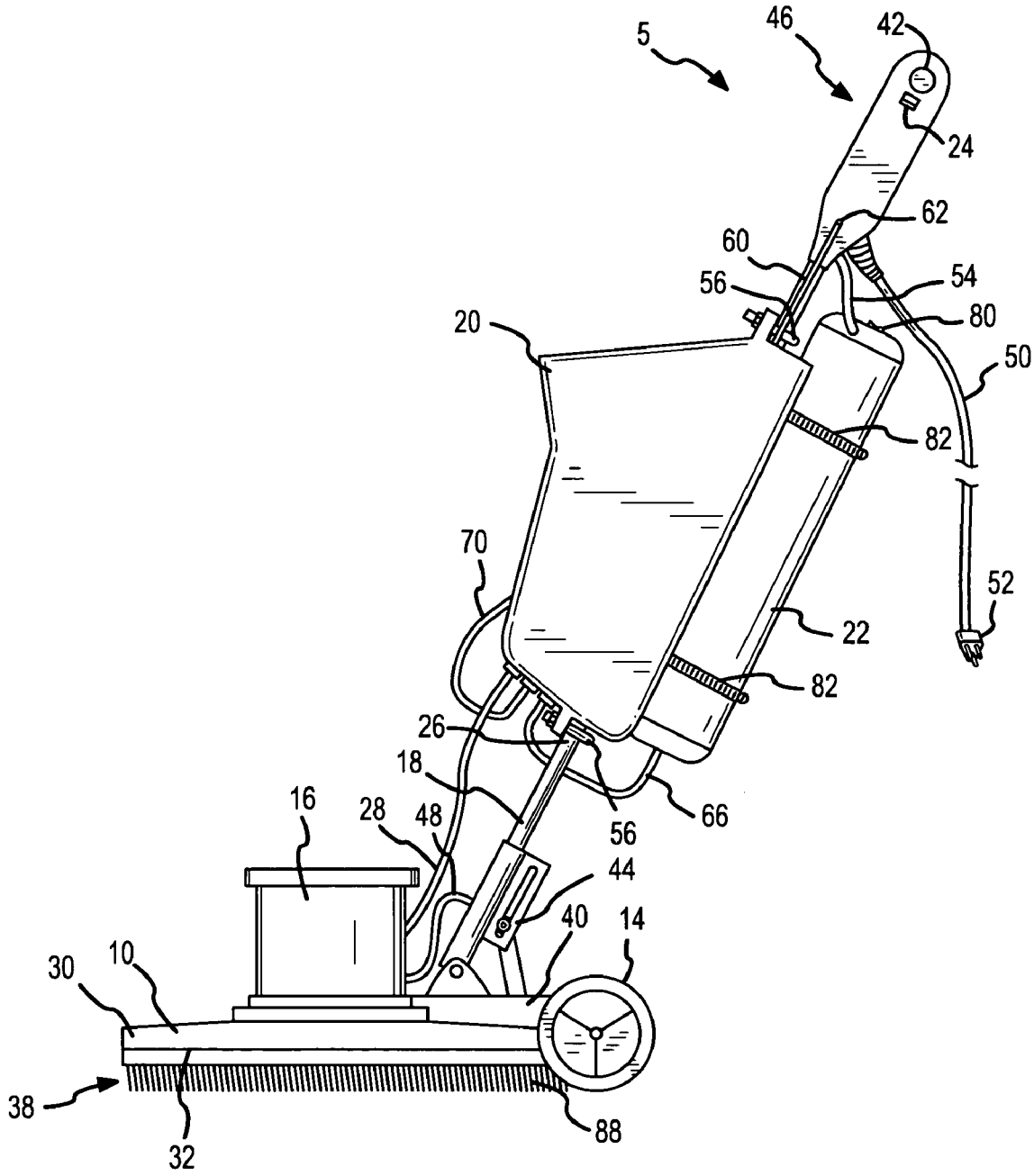
FIG. 2 is a side view of a carpet cleaning machine according to one embodiment of the present invention.
Figure 3:
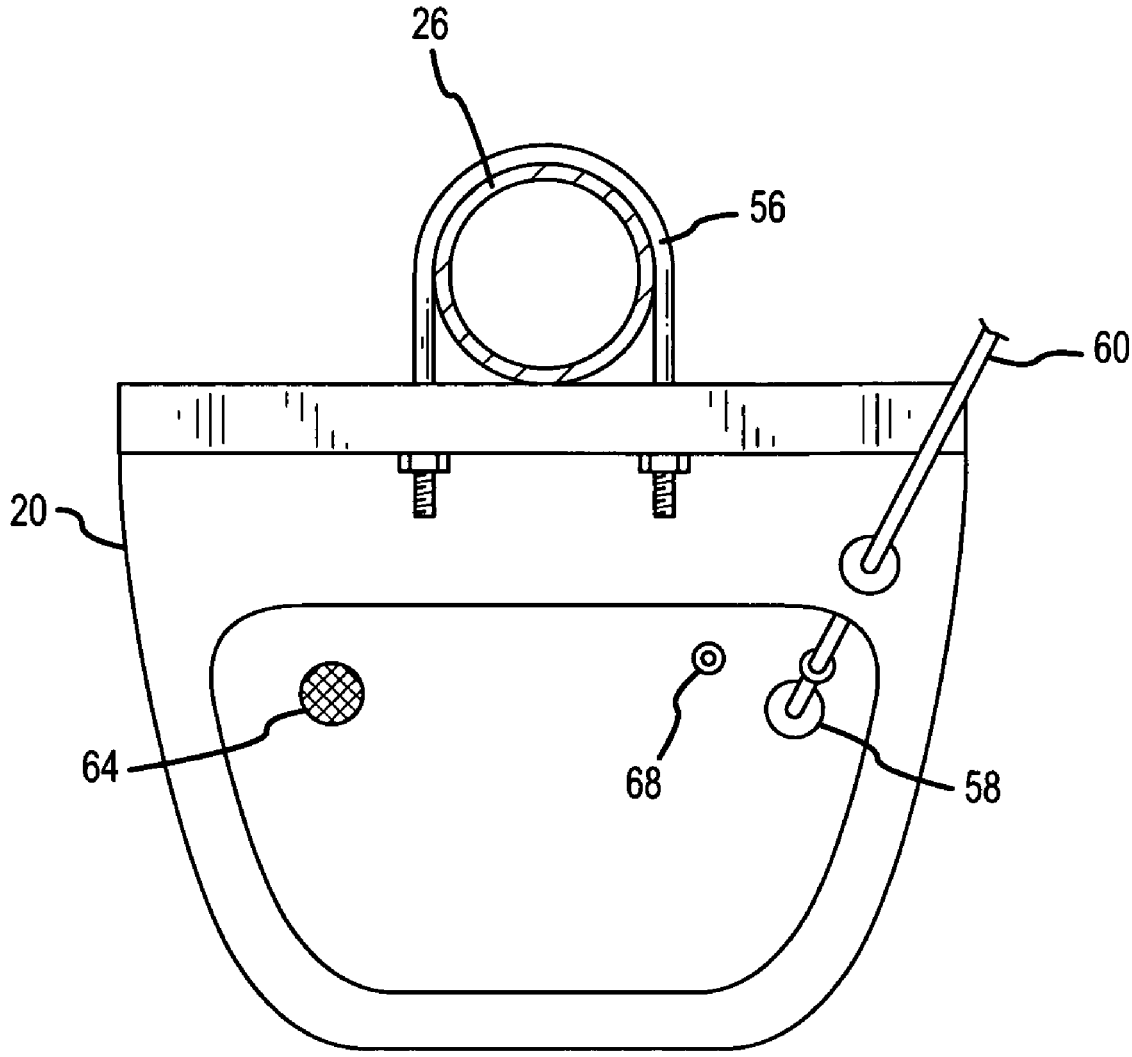
FIG. 3 a top view of the reservoir according to one embodiment of the present invention.

A Rotary Carpet Cleaning Apparatus Incorporating a Heated Cleaning Solution Reservoir According to One Embodiment of the Present Invention Referring to FIGS. 1 & 2, a rotary carpet cleaning machine 05 (also referred to as a bonnet-style carpet cleaning machine) is illustrated according to one embodiment of the present invention. The machine comprises (i) a generally circular base shroud 10 to which a pair of support wheels 14 are coupled to the rear thereof; (ii) an electric motor 16 mounted to the top of the shroud having its shaft substantially vertically orientated and positioned in the center of the shroud; (iii) a handle assembly 18 that is pivotally connected to the shroud and includes levers 24 for controlling the motor's operation; (iv) a cleaning solution reservoir 20 mounted to a shaft 26 of the handle assembly for holding liquid cleaning solution that includes a hand-actuated valve and tube 28 for dispensing the solution; and (v) a heater assembly 22 including an electric heater and a fluid pump for heating the cleaning solution (see FIG. 4). A large diameter brush (such as illustrated in FIG. 3) is placed under the shroud and is attached to the shaft of the electric motor to facilitate agitation of the carpet pile during cleaning.

The shroud 10 typically comprises a top portion 30 that is generally planar and a side portion 32 that circumscribes most of the top portion and extends downwardly therefrom. The top portion in the illustrated embodiment comprises aluminum although in other variations the top portion can comprise other metals, composite materials, or polymeric materials. The side portion in the illustrated version also comprises aluminum and is integrally formed with the top portion. A resilient semi-flexible polymeric material, such as a synthetic rubber, covers the exterior of the shroud's side portion to minimize the potential for damage to walls and furniture that the machine may impact during use. In variations other materials can be used in place of the semi-flexible polymeric material. Additionally, at least one opening 34 extends through the top portion to permit the tube 28 extending from the reservoir 20 to pass therethrough wherein the cleaning solution can be delivered to the brush and subsequently the carpet pile as is described in greater detail below. Functionally, the shroud acts to enclose the top and side surfaces of the brush. Further, the shroud 10 provides a framework for the machine to which the electric motor 16, the handle assembly 18 and the support wheels 14 are secured.

The electric motor 16 is coupled to shroud 10 proximate the shroud's center with at least the shaft (not shown) of the motor extending completely through the shroud. An adapter 36 (see FIG. 6) is secured to the shaft for coupling the shaft with the large diameter brush 38. Typically, the electric motor is typically rated at 0.5 to 1.5 horse power and is adapted to operate on standard 115v household current. The motor typically includes a transmission that facilitates a relatively low rotation rate of the shaft of 150-350 revolutions per minute while providing a high level of torque to prevent the friction between the brush and the carpet pile from stalling the motor. In one preferred variation, the electric motor is rated at 1½ horse power and has a rotational speed of about 175 revolutions per minute. In other variations and embodiments of the carpet cleaning machine motors having ratings greater than 1½ horse power or less than ½ horse power can be utilized as can motors that operate on other 220v or other currents.

The support wheels 14 are rotatably coupled to the shroud by way of a boom 40 that extends from a location proximate the motor housing rearwardly to a location aft of the shroud. The boom can be integrally formed with the shroud, welded to the top portion of the shroud or mechanically coupled thereto. Operationally, a user can tilt the machine downwardly from the handle 42 on the handle assembly 18 pivoting the brush 38 off the ground about the axis of the wheels thereby permitting the user to maneuver the machine when the motor and the brush are off. Further when the brush is rotating, a user can apply pivotal pressure about the wheels' axis to both control the amount of pressure applied to the carpet at the rotating brush and facilitate the movement of the machine in a direction contrary to the direction the machine is naturally pulled as a result of the brush's rotation.

The shaft 26 of the handle assembly 18 extends rearwardly and upwardly from a location on the shroud 10 behind the motor 16. The shaft is pivotally connected to the housing permitting it to be raised or lowered to accommodate the height of a user. Further, once a suitable height is determined a mechanism 44 is provided to selectively lock the assembly in place.

The handle assembly 18 comprises: (i) an elongated member 26 (also referred to as a shaft) that extends from a proximal end coupled with the shroud 10 and a distal end; (ii) a T-shaped handle portion 46 at the distal end; and (iii) a motor activation switch encased in the T-shaped handle portion's housing and associated levers 24. The elongated member is typically a tubular shaft comprising round steel or aluminum tubing, although in variations the elongated member can comprise a solid rod or a non-tubular elongated structure, such as but not limited to C-channel. In the illustrated embodiment, an electrical cord 48 extends from the motor to a junction (not shown) in the T-shaped handle portion housing substantially in the interior of the tubular elongated member. An extended power cord 50 extends from the T-shaped portion and terminates in a typical household three-pronged plug 52. The junction is coupled to a switch that turns on the motor whenever one or both of the levers 24 operatively coupled with the switch are actuated. Also coupled to the junction is a power cord 54 that extends from the junction out of the T-shaped handle portion 46 and is coupled to the heater assembly 22, which is described in greater detail below.

The T-shaped handle portion 46 includes substantially horizontal grips 42 (or handles) that extend out of each side of the vertical section of the T-shaped handle portion. To use the machine, a user grips one grip with each of his/her hands and pulls at least one of the levers 24 towards the corresponding grip to turn on the motor. The machine is manipulated and moved to and fro over the underlying carpet by the user through the grips.

The reservoir 20 is clamped to the elongated member 26 of the handle assembly 18 typically using two or more U-clamp bolts 56. The reservoir is typically comprised of a polymeric material such as polypropylene or polyethylene although other suitable materials can be used as well. The cleaning solution is contained within the reservoir.

Also referring to FIG. 3, a mechanical valve 58 is provided at the bottom end of the reservoir. An elongated metal rod 60 extends is attached to the valve. The rod extends upwardly through a top end of the reservoir and is bent proximate its distal end to from a valve actuation handle 62 that is located a short distance below a corresponding grip portion of the handle portion. The mechanical valve is also coupled to a hose or flow tube 28 that extends downwardly through the aforementioned opening 34 in the shroud 10 wherein the tube terminates. Operationally, pulling upwardly on the valve actuation handle, the mechanical valve is opened permitting cleaning solution to flow by force of gravity from the reservoir 20 through the hose and onto the top of the brush located inside of the shroud. By releasing the valve actuation handle, the valve closes and the flow of solution is stopped.

On the bottom end of the reservoir, a second outlet 64 that is covered with a debris screen is provided. This outlet is coupled to a heater assembly inlet hose 66. On the back wall of the reservoir a reservoir inlet 68 is provided. The inlet is coupled to a heater assembly outlet hose 70. Together, this outlet and inlet pair facilitates the flow of cleaning solution to and from the heater assembly 22. The pair is typically and preferably located below the cleaning solution level line during normal operation so that air is not introduced into the solution which could cause it to foam, thereby inhibiting the flow of solution through the mechanical valve and to and from the heater assembly. Otherwise, the locations and specific configurations of the inlet and outlet pair can vary as would be obvious to one of ordinary skill in the art given the benefit of this disclosure.

Figure 4:
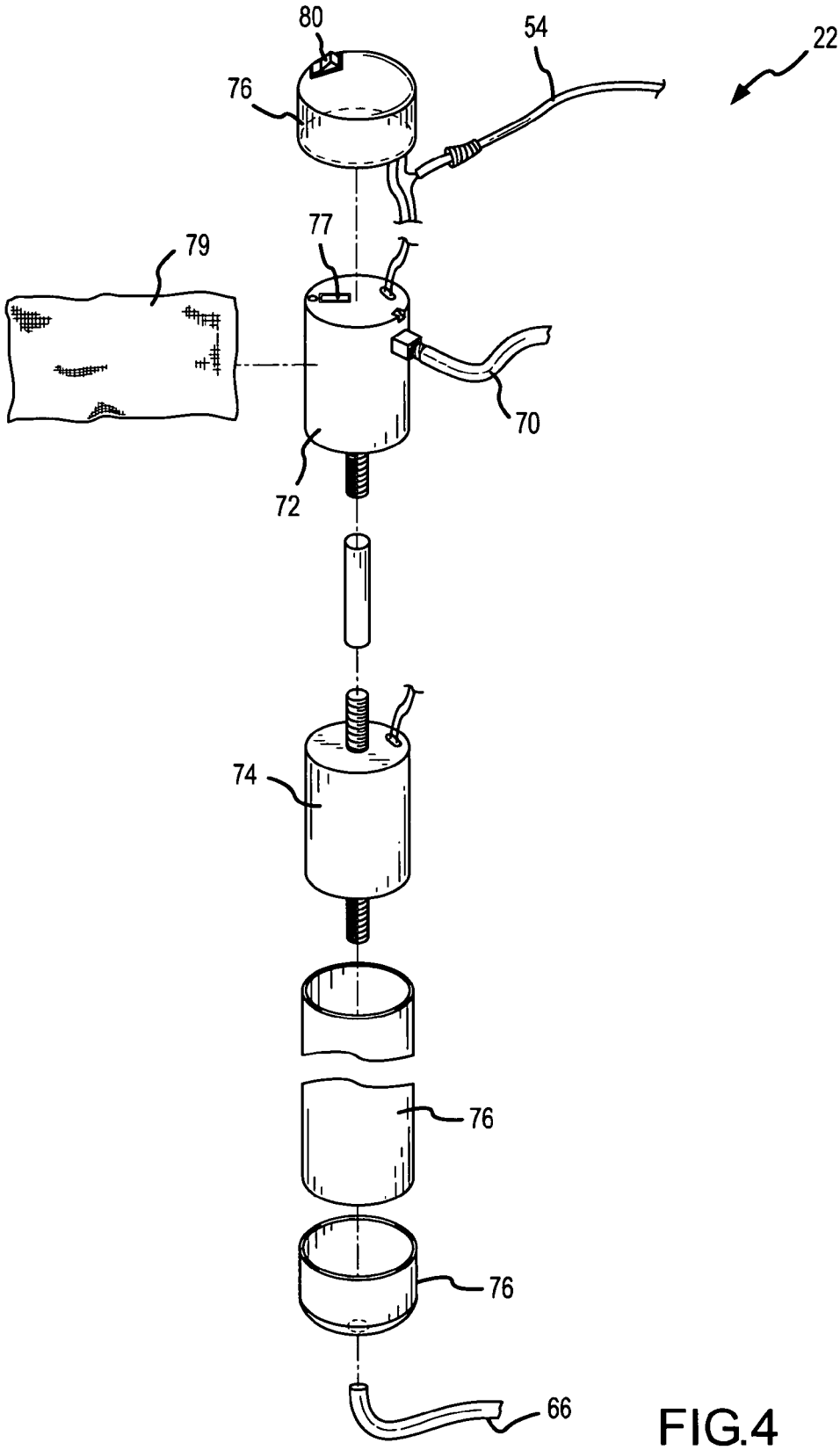
FIG. 4 is an exploded of the reservoir and associated heater assembly according to one embodiment of the present invention.

The heater assembly 22 as shown in FIG. 4 typically comprises: (i) a heater core 72; (ii) a pump 74; (iii) housing 76; (iv) plumbing to and from the reservoir including the aforementioned inlet and outlet hoses 66 and 70; and (v) an optional thermostatic switch 77 to turn the assembly off and on depending on the temperature of the solution. The thermostatic switch is illustrated herein as being integrated with the heater core, although in other variations and embodiments it can be separate therefrom. The housing 76 as illustrated comprises a 3" diameter piece of PVC tubing and two closed end caps. The heater core and the pump are completely contained in the housing and thermal insulation 79 can be wrapped around the heater core prior to inserting it into the housing to help ensure the outside temperature of the housing does not exceed a safe level that could burn a person touching the housing. In certain variations, an on/off rocker switch 80, which is electrically coupled to the pump and heater core, is mounted to the housing, such as in the top end cap to permit a user to turn the assembly off and on separately of the machines motor and associated brush. The housing is secured to the elongated member of the handle assembly by a plurality of hose clamps 82 or any other suitable means (see FIGS. 1 and 2).

The heater core typically comprises a 12v electric resistance heater having a fluid passage therethrough. One heater core found to be suitable for the present application is a 1200 watt in-line heater. The fluid pump, which is also electric, as illustrated is mounted below the heater core and acts to pull fluid from the reservoir through the inlet hose(s). One fluid pump found to be suitable for the present invention includes a Flojet reciprocating pump that is rated at 0.37 gallons per minute at 55 psi. The heater core and the pump are electrically coupled to a power cord through the aforementioned rocker switch that is electrically coupled to the junction in the handle portion.

In preferred variations, the pump and the heater core are electrically coupled to an intervening thermostatic switch 77 that is fluid communication with the cleaning solution. In certain variations, the thermostatic switch can comprise a component of one of the heater and the pump or it can be distinct from the heater and the pump. In any case, however, thermostatic switch is coupled between the power supply cord and electrical connections for the pump and heater core. Once the fluid reaches a certain temperature, the thermostatic switch turns the pump and heater off until the temperature drops below a second preset level. For instance, in one variation the thermostatic switch trips off at about 200 degrees Fahrenheit and closes to supply current to the pump and heater at about 190 degrees Fahrenheit.

Operationally, when the machine 05 is plugged into a household socket and the rocker switch 80 is turned on, cleaning solution is pulled from the reservoir outlet, through the inlet hose 66 to the pump 74 wherein it is pushed upwardly and through the heater 72 and the outlet hose 70 back into the reservoir 22 below the cleaning solution level line at the inlet. The fluid is continuously circulated through the heater core until it has been heated to the trip temperature of the thermostatic switch 77 when the switch turns off power to the heater and the pump.

Figure 5:
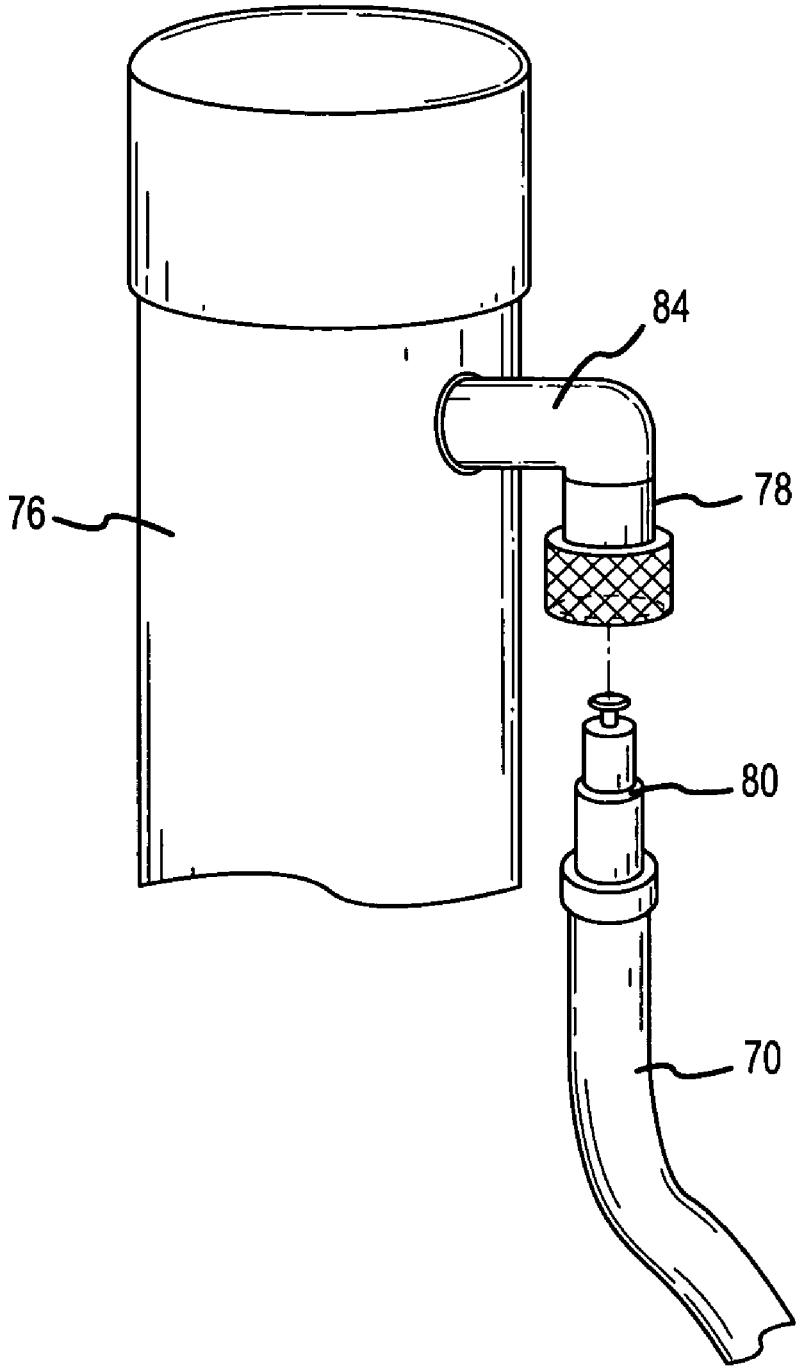
FIG. 5 is a view of the quick connect coupling of the heater assembly according to according to an embodiment of the present invention.

In certain variations, such as illustrated in FIG. 5, the outlet hose 70 is coupled to the outlet fixture of the heater core 72 by way of a pair of quick connect couplings 78 & 80. The female coupling 78 is attached to the outlet fixture 84 of the heater core and the associated male coupling 80 is attached to the proximal end of the outlet hose. Accordingly, a user can detach the outlet hose and connect another hose or flow line to the heater assembly. For instance, a hose having a suitable quick disconnect fitting that is connected to a stair/upholstery cleaning device 100, such as the one described below, can be coupled to the heater outlet fixture to permit the heated cleaning solution from the reservoir 20 to be used to clean stairs and upholstery. Additionally, the reservoir can be emptied of the cleaning solution by connecting a suitable hose to the quick connect 78 on the outlet fixture 84 and pumping the cleaning solution out of the reservoir perhaps into a storage container.

Figure 6:
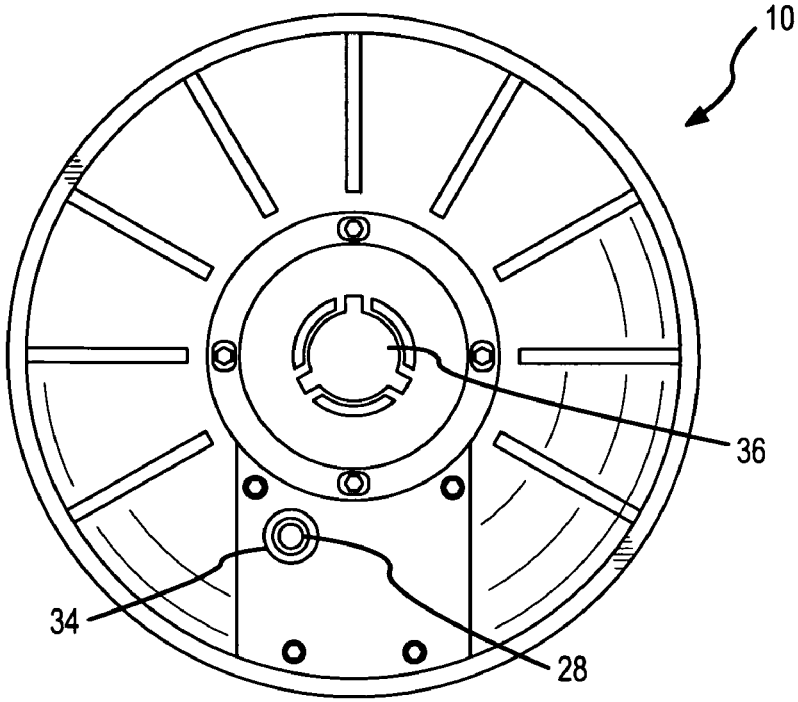
FIG. 6 is a bottom view of the shroud according to according to an embodiment of the present invention.

Referring to FIG. 6, a bottom view of the shroud is provided. As illustrated, the opening 34 has the terminus of the hose 28 from the reservoir received therein. Also, the adapter 36 is provided for coupling the motor to the brush.

Figure 7:
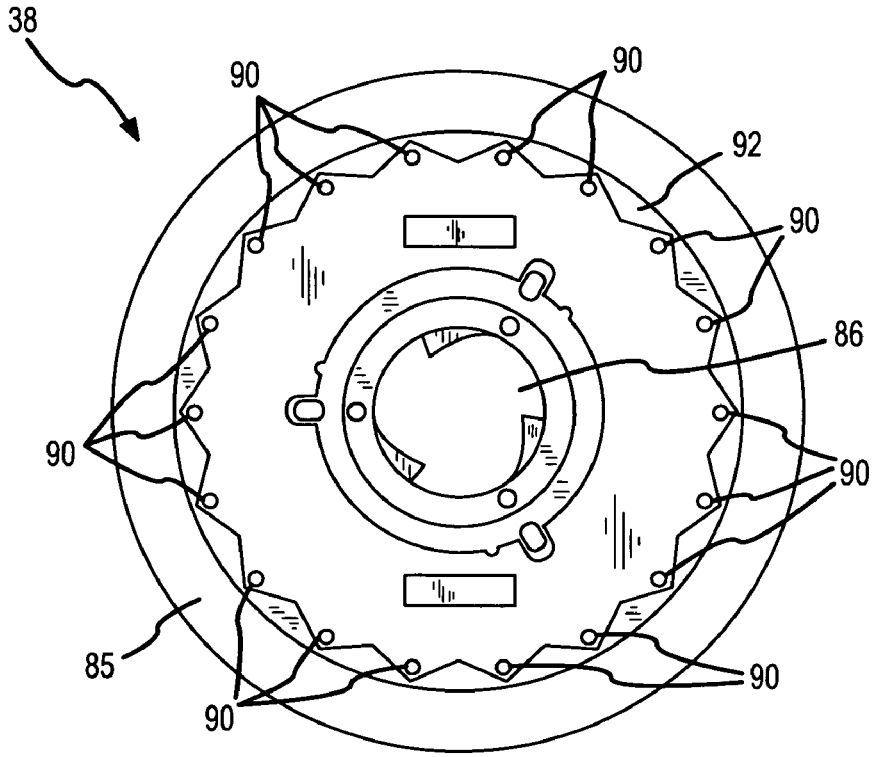
FIG. 7 is a top view of the brush according to according to an embodiment of the present invention.
Figure 8:
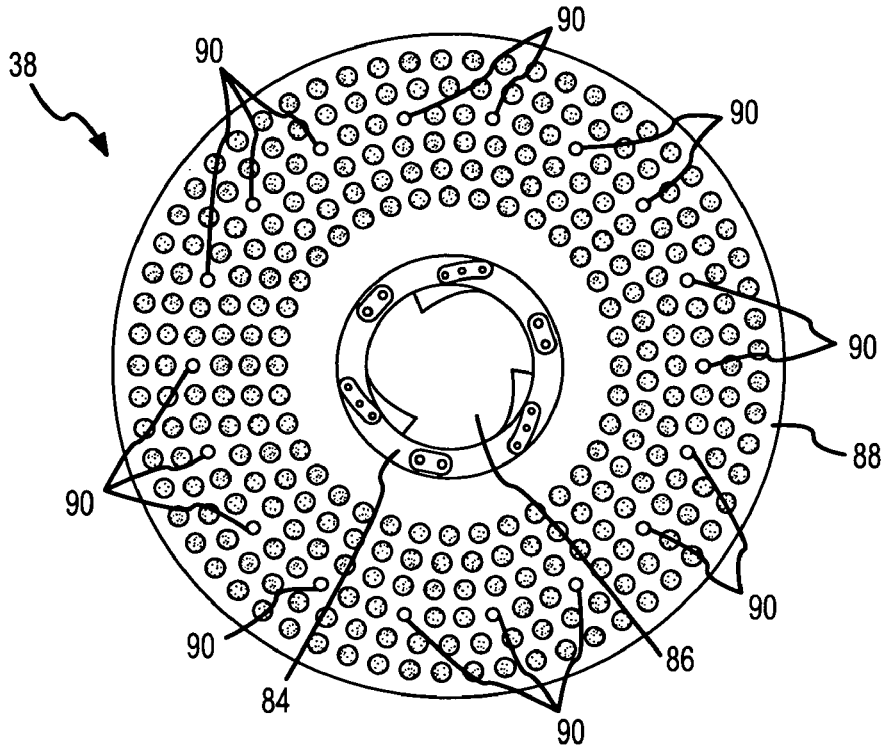
FIG. 8 is a bottom view of the brush according to according to an embodiment of the present invention.

The top of the brush 38 is illustrated in FIG. 7. The brush is circular having a diameter of about 12" to 24" and more preferably 17-23". The brush comprises a disk shaped base portion 85 having upper and lower surfaces. The disk typically comprises a molded polymeric material, such as nylon that can be reinforced with fiberglass, although other materials can be used as well. The disk includes a center opening 86 through which the adapter 36 is received and secured. A plurality of bristle bunches 88 extend downwardly from the disk. The stiffness, configuration and composition of the bristles can vary from brush to brush with different configurations of brushes being available for use on different types of carpet. Approximately, 75-80% of the distance between the center and the edge of the disk, a plurality of openings 90 extend generally vertically through the disk between the upper and lower surfaces. The openings are typically around circumambiently around the disk. Located radially outwardly of the openings is a raised ridge 92 that also extends circumambiently around from the top surface of the disk. This ridge helps to funnel the cleaning solution into the openings and down to the carpet surface.

During the operation of the cleaning machine, the user pulls upwardly on the valve actuation handle and causes heated cleaning solution to flow out of the reservoir, through the associated hose, and onto the upper surface of the brush's disk. Centrifugal forces push the solution to the plurality of openings wherein the solution flows downwardly towards the carpet pile. The temperature of the solution as it is delivered to the pile is preferably between 150-200 degrees Fahrenheit and more preferably 170-190 degrees Fahrenheit and most preferably about 180 degrees Fahrenheit. Once the solution has reached the pile, it is stirred and agitated by the bristles of the brush causing it to foam. The high temperature of the foamed cleaning solution combined with the aggressive agitation provided by the brush facilitates the cleaning of the carpet pile and fibers.

Figure 10:
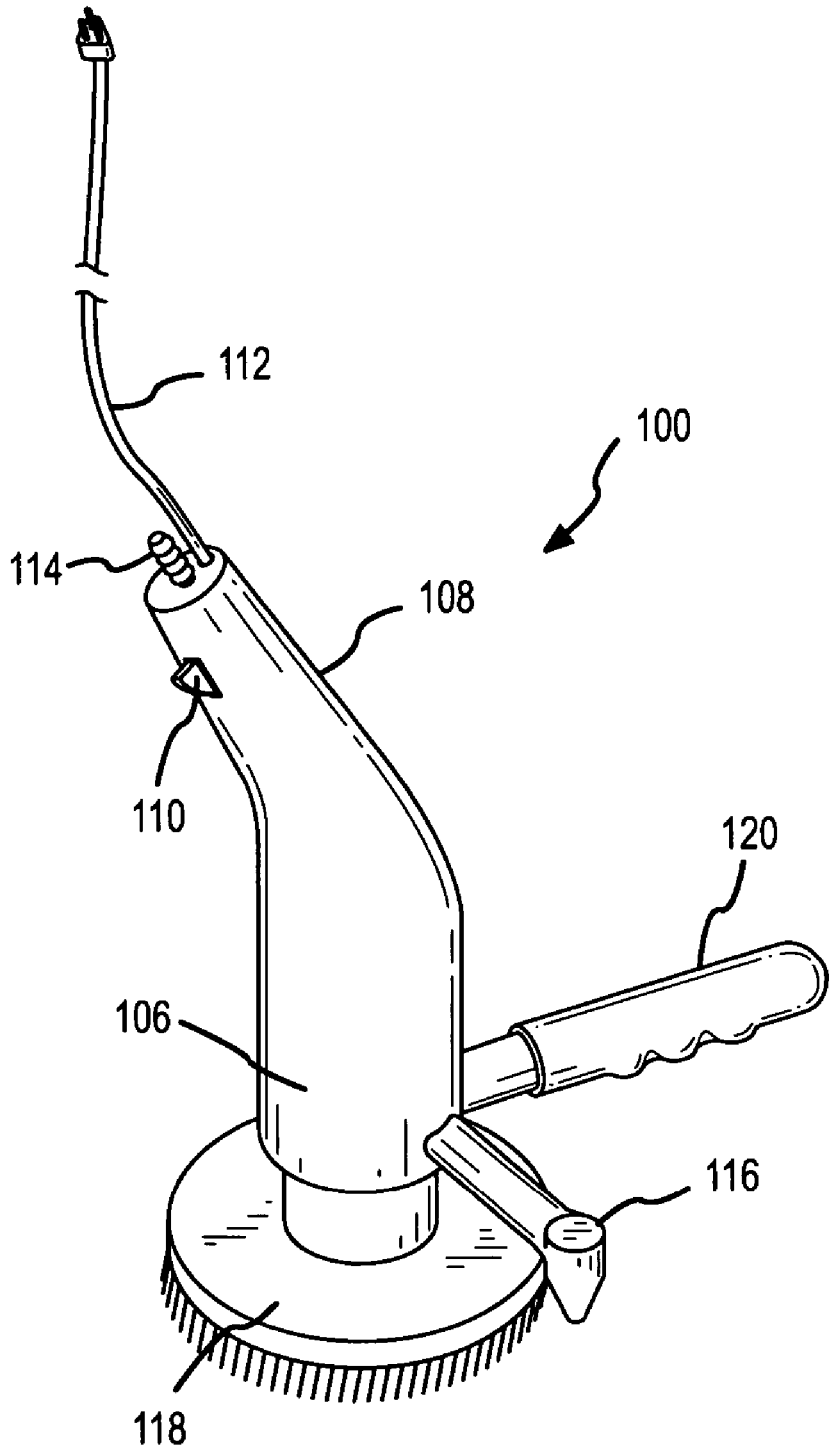
FIG. 10 is an isometric view of an upholstery/stair tool according to one embodiment of the present invention.

FIG. 10 is an illustration of a carpet/stair cleaning tool 100 that can be utilized in conjunction with embodiments of the rotary carpet cleaning machine. The tool is sized to be hand held and so that it can fit into spaces that the cleaning machine with its relatively large diameter brush cannot. As shown, the tool comprises a housing 106 from which an integral handle extends 108 outwardly and upwardly therefrom. A trigger actuator 110 that is coupled to a switch contained in the housing extends from the bottom side of the integral handle for turning a electrical motor contained within the housing off and on as well as variably controlling the motor's speed. An electrical cord 112 and a quick connect fitting 114 extend from the end of the handle. The electrical cord is adapted for use with a standard household receptacle and the quick release fitting is adapted to couple to a cleaning solution hose that is also adapted to be coupled to the quick connect fitting 78 of the carpet cleaner's outlet fixture 84. A boom having a spray nozzle 116 extends from the front of the housing and is coupled to the quick connect fitting 114 by way of a tube or other conduit that is contained in the housing. Accordingly, cleaning solution can be sprayed onto the upholstery or carpeting being cleaned. In some variations of the tool, the trigger actuator may also be electrically coupled to a solenoid that opens and closes a valve to permit or prevent cleaning solution from flowing from the spray nozzle. As illustrated the motor (not shown) is situated in the housing such that its shaft is vertically orientated and a brush 118 generally similar to the brush used in the larger brush of the carpet cleaning machine is attached to the shaft. Additionally, a second handle 120 can be provided that extends generally horizontally from the housing so that a user may hold the tool with both hands to provide additional control thereof.

Operationally, a user fluidly couples the tool 100 with the heater assembly 22 via a hose having the appropriate quick connect fittings. The tool is also plugged into a standard household receptacle. The user turns on the heater assembly so that the associated pump is operational. The user than depresses the trigger actuator 110 to dispense cleaning solution and to rotate the tool's brush 118 while applying pressure to the underlying carpet or upholstery. After an area has been cleaned, the carpet is permitted to dry and then any dried cleaning solution residue and associated removed dirt and soil is vacuumed up.

Any suitable dry foam machine or rotary carpet cleaning machine cleaning solutions currently on the market can be used with embodiments of the carpet cleaning machine. One formulation determined to be effective with the various embodiments comprises about 10% sodium laureth sulfate and about 3% sodium olefin sulfonate both of which act as surfactants to reduce the surface tension of the water in the solution to permit the water to fully penetrate the carpet fibers. The cleaning solution also includes about 2% isopropyl alcohol that acts to disperse greases and oils in the carpet fibers and promotes faster drying. About 1% DPM is also provided and it also acts to break down and emulsify oils and greases. In addition, dipropylene glycol methyl ether disperses other contaminants commonly found in carpet and upholstery fibers. Another type of solvent found in about a 1% concentration to break down oils and greases is citrus terpenes. Further, less than 1% sodium metasilicate is provided to boost the PH of the cleaner to promote the cleaning process. Finally, less than 1% of borax is provided that acts as a detergent booster and also acts to encapsulates soils that is easily vacuumed up when the borax crystallizes as the carpet dries up. Other chemicals and agents can be added or substituted for the listed ingredients as suitable. The balance of the cleaning solution comprises water.

To clean a carpet with embodiments of the rotary carpet cleaning machine, a user first at least partially fills the tank or reservoir of the cleaning machine with cleaning solution such as but not limited to the solution described above. Next, the user turns on the heater assembly to circulate the cleaning solution through the heater core and heat the solution to about 150-210 degrees Fahrenheit. In one embodiment, the pump and heater will switch off once the cleaning solution has reached a preset temperature causing the thermostatic switch to be tripped. In another embodiment, the heater assembly turns back on when the temperature in the reservoir cools below a preset temperature. Once the temperature has been reached the user turns on the motor to cause the large diameter brush to rotate and generally simultaneously releases cleaning solution on to the carpet be pulling upwardly on the valve actuation handle. The temperature of the cleaning solution when it contacts the carpet fibers is typically about 130-180 degrees Fahrenheit depending on the initial temperature of the cleaning solution when it leaves the reservoir. The user then moves the rotating brush over the carpet to scrub the underlying carpet and cause the cleaning solution to foam. By pushing down on the handle of the cleaning machine the user can control the pressure at which the brush is applied to the carpet. As necessary the user can attach the stair and upholstery cleaning tool to the heater assembly to clean stair, upholstery and/or corners of a carpeted floor that cannot be reached by the large brush of the cleaning machine. Once finished the carpet is permitted to dry and the dirt and residue is subsequently vacuumed up.

Alternative Embodiments and Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

Figure 9:
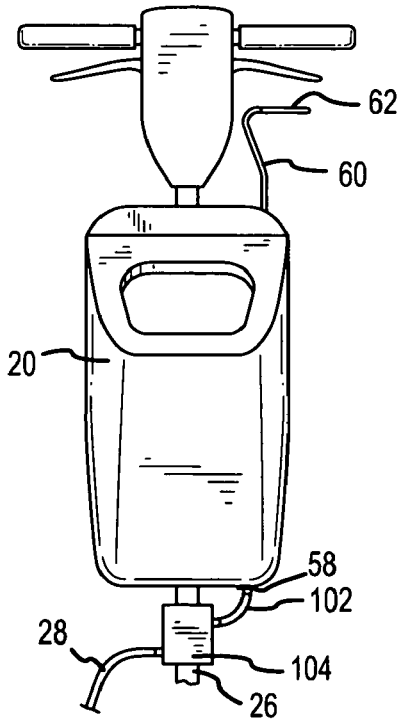
FIG. 9 is a partial isometric view of an alternative embodiment carpet cleaning machine according to according to an embodiment of the present invention.

Referring to FIG. 9, one alternative embodiment of the carpet cleaning machine is illustrated wherein the heater assembly is replaced with an inline heater core 104 that is mounted to the elongated shaft 26 of the handle assembly below the reservoir. The heater is fluidly coupled to the reservoir 20 by way of a tube 102 or other conduit that is attached to the mechanical valve 58 at the bottom of the reservoir. Another tube 28 or conduit extends from the bottom of the heater core to the opening 34 in the shroud 10. Accordingly when the user pulls upwardly on the valve actuation handle 62, the cleaning solution flows downwardly through the heater and heats up to 150-210 degrees Fahrenheit before being deposited on the rotating brush and eventually the carpet surface. This configuration minimizes the ability of the solution to cool down before being deposited on the carpet surface. Further, the use of a pump is eliminated although in other variations of this configuration a pump can be provided in line or integrally with the heater core 104.

In other embodiments the means by which the cleaning solution is deposited on the carpet can vary for instance a boom and spray nozzle similar in operation to the one illustrated with reference to the stair/upholstery tool can be used. In other embodiments, the brush can be replaced by a cleaning pad or the brush can vary significantly in configuration from the one illustrated herein as would be obvious to one of ordinary skill in the art given the benefit of this disclosure. In yet other embodiments, the configuration of the cleaning machine can vary significantly and substantially. For instance, the heater assembly can be located on the top of the shroud instead of to the shaft of the heating assembly. Further, the specifications of the heater core and pumps used in the heating assembly can also vary.

I claim:

1. A carpet cleaning machine comprising: a disk-shaped brush adapted for rotating along an axis generally perpendicular to a carpet surface, the brush having a diameter of at least about 12 inches; a motor coupled to the brush; a handle assembly including a handle permitting a user to manipulate and move the machine over a carpet, the handle assembly being operatively coupled to the motor; a reservoir adapted to contain a foaming cleaning solution; a conduit extending from the reservoir to a brush outlet proximate the brush; and a heater assembly adapted to heat the solution contained in the reservoir to at least 180 degrees Fahrenheit; wherein (a) the carpet cleaning machine does not include an means for extracting the solution from the carpet, (b) the heater assembly further comprises a housing separate from the reservoir having a pump and heater contained therein, and (c) the machine further comprises (i) a first conduit extending between an outlet location on the reservoir and an inlet location on the heater assembly, and (ii) a second conduit extending between an outlet location on the housing and an inlet location on the reservoir.

2. The carpet cleaning machine of claim 1, wherein the heater assembly is attached to the handle assembly.

3. The carpet cleaning machine of claim 1, wherein the machine is adapted to deliver solution at about 150 to 180 degrees Fahrenheit to the carpet surface.

4. The carpet cleaning machine of claim 1, wherein the second conduit further includes a quick disconnect assembly for selectively fluidly uncoupling the heater assembly and the reservoir, the quick disconnect including mating male and female portions.

5. The carpet cleaning machine of claim 4, further comprising a stair/upholstery cleaning tool, the stair/upholstery cleaning tool including elongated flexible tubing, one end of the tubing including one of a male or female portion of a quick disconnect assembly, the one of the male or female portion of a quick disconnect assembly of the stair cleaning tool being adapted to couple with the corresponding male or female portion of the second conduit.

6. The carpet cleaning machine of claim 1, wherein the diameter of the brush is at least 20" and the motor is rated at least 1.5 hp.

7. The carpet cleaning machine of claim 1, wherein the brush outlet is located above a top surface of the brush and the brush includes a plurality of holes adapted to permit the solution deposited on the top surface to pass therethrough down to bristles and the carpet surface.

8. A bonnet-style carpet cleaning machine comprising: an electric motor having a rating of at least 1 hp; a shroud, the motor being coupled to the shroud; a handle assembly including a handle permitting a user to manipulate and move the machine over a carpet, and a shaft extending between a distal location terminating proximate the handle and a proximal location, the handle assembly being coupled to the shroud proximate the proximal location; a brush assembly, the brush assembly comprising (i) a substantially horizontally-orientated disk with a diameter of at least 18" having top and bottom surfaces and having a plurality of holes passing between the top and bottom surfaces,(ii) a plurality of bristles extending generally vertically downwardly from the bottom surface,the brush assembly being operatively coupled to the motor for rotation about an axis of the disk; a tank adapted to hold a cleaning solution; a first conduit extending between the tank and a location proximate the top surface of the brush assembly; a user actuated valve for controlling the flow of solution from the tank and though the first conduit; a heater assembly, the heater assembly comprising a heater operatively coupled with a pump; a second conduit extending between the tank and the heater assembly for carrying solution from the tank to the heater assembly; a third conduit extending between the tank and the heater assembly for carrying solution from the heater assembly back to the tank.

9. The bonnet-style carpet cleaning machine of claim 8, further comprising a stair/upholstery cleaning tool and a fourth conduit, wherein the third conduit and the fourth conduit include corresponding quick disconnect couplings permitting the stair/upholstery cleaning tool to be operatively coupled with the heater assembly to facilitate the flow of cleaning solution to the stair/upholstery cleaning tool.

10. The bonnet-style carpet cleaning machine of claim 9, wherein the heater assembly further comprises a housing in which the pump and the heater are substantially contained, and wherein the housing is coupled to the shaft.

11. The bonnet-style carpet cleaning machine of claim 10, wherein the housing comprises a PVC pipe.

* * * * *